US007079106B2

(12) United States Patent
Matsuda et al.

(10) Patent No.: US 7,079,106 B2
(45) Date of Patent: Jul. 18, 2006

(54) SIGNAL OUTPUT DEVICE AND DISPLAY DEVICE

(75) Inventors: Noboru Matsuda, Soraku-gun (JP); Kazuhiro Maeda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 308 days.

(21) Appl. No.: 10/427,924

(22) Filed: May 2, 2003

(65) Prior Publication Data

US 2003/0214476 A1 Nov. 20, 2003

(30) Foreign Application Priority Data

May 17, 2002 (JP) ..... 2002-143747
Jan. 17, 2003 (JP) ..... 2003-010274

(51) Int. Cl.
*G09G 3/36* (2006.01)

(52) U.S. Cl. ..... 345/100; 345/87; 345/98; 345/204; 345/206

(58) Field of Classification Search ..... 345/100, 345/98, 87, 204, 206
See application file for complete search history.

(56) References Cited

U.S. PATENT DOCUMENTS 6,049,321 A 4/2000 Sasaki
6,300,930 B1 10/2001 Mori
6,407,730 B1 * 6/2002 Hori ..... 345/100
6,727,879 B1 * 4/2004 Sako ..... 345/98
2001/0052888 A1 * 12/2001 Hebiguchi ..... 345/87
2003/0016196 A1 * 1/2003 Lueder et al. ..... 345/82
2003/0025658 A1 * 2/2003 Janssen et al. ..... 345/87
2003/0112230 A1 6/2003 Maeda et al.

FOREIGN PATENT DOCUMENTS

JP 64-018193 1/1989
JP 08-122748 5/1996
JP 11-30975 A 2/1999
JP 11-095729 4/1999

OTHER PUBLICATIONS

Korean Office Action and English translation thereof mailed Jun. 28, 2005 in corresponding Korean application No. 10-2003-31301.
Chinese Office Action and English translation thereof mailed Jul. 1, 2005 in corresponding Chinese application No. 03136512.4.
Korean Office Action mailed Oct. 14, 2005 (w/English translation thereof).

* cited by examiner

*Primary Examiner*—Bipin Shalwala
*Assistant Examiner*—Leonid Shapiro
(74) *Attorney, Agent, or Firm*—Nixon & Vanderhye, P.C.

(57) ABSTRACT

A source driver of the present invention includes a bypass switch which connects two source lines with each other. A video signal to one of the source lines is simultaneously supplied to the other source line. The source driver is thus capable of indirectly transmitting a video signal of a video line, supplied to one source line, to the other source line. Therefore, according to the source driver, it is possible to transmit video signals on fewer image lines than the number of source lines. As a result, it is possible to significantly lower power consumption.

17 Claims, 7 Drawing Sheets

SIGNAL OUTPUT DEVICE AND DISPLAY DEVICE

FIELD OF THE INVENTION

The present invention relates to a signal output device for supplying image signals, via image lines, to source lines of a display device.

BACKGROUND OF THE INVENTION

A liquid crystal panel using a polysilicon or CG (Continuous Grain) silicon substrate enjoys a better TFT characteristic than that using an amorphous silicon substrate.

The better TFT characteristic means higher electrical charge mobility, which makes it possible to monolithically mount, on the liquid crystal panel, circuits (a source driver, a gate driver, and the like) for driving the liquid crystal panel.

Usually, such a liquid crystal panel is a display panel composed of pixels arranged in a matrix (a matrix-type display panel). Other known matrix-type display panels include an EL (Electro Luminescence) panel and a plasma display panel.

The matrix-type display panels above are not capable of attaining an operating speed as high as that of an LSI because the transmission of signals via signal lines is delayed due to sizes (physical length) of the matrix-type display panels.

In order to overcome this drawback, some matrix-type display panels perform multi phase process at source drivers.

The "multi phase" is one form of parallel operation, in which each of video signals (R, G, and B) transmitted to the source driver is resolved into two to eight signals by such as serial-parallel conversion, and the resolved signals are transmitted through a plurality of video signal lines.

Because this processing reduces the amount of information (a frequency characteristic) per signal line, it is possible to easily increase the operating speed of the matrix-type display panel. Therefore, it is possible to attain, without interruption, a satisfactory display result even when the display signals (video signals) are those of a moving picture.

Moreover, for a matrix-type display panel, a technology has been developed as to lower resolutions in vertical and horizontal directions in order to increase the operating speed.

This technology is for simultaneously transmitting the same signal to adjacent source lines and adjacent gate lines by adding analog switches to the source driver or a gate driver.

Specifically, this technology makes it possible, for example, to transmit the same video signal to four pixels that are adjacent in the horizontal and vertical directions. By so doing, it is possible to increase the operating speed nearly four times faster. Moreover, it is also possible to reduce power consumption because the driving frequency can be reduced to one fourth if the operating speed is not changed.

Some display panels are capable of selectively performing a display operation in a low resolution mode, as described above, and in a high resolution mode in which all pixels receive different video signals so as to carry out display at high resolutions.

For example, Japanese Publication for Unexamined Patent Application, No. 64-18193, Tokukaisho (publication date: Jan. 20, 1989) discloses a technique for switching the high resolution mode and the low resolution mode of a display panel by switching connections of a source driver, using analog switches.

In this technique, a video signal or a data signal (display signals for a still picture) is supplied to each of four source lines via four bus lines. In the high resolution mode for still pictures, different data signals are respectively supplied to the four bus lines, while the same video signal is supplied to the four bus lines in the low resolution mode for moving pictures.

In this manner, this technique realizes a convenient way of providing the circuit with a function of switching the resolutions by adding the analog switches to the source driver.

However, the technique disclosed in the foregoing publication requires display signals to be supplied to all the bus lines, regardless of the resolution modes. This causes a problem that cost and calorific value cannot be reduced drastically, owing to the fact that power consumption can only be reduced to a limited extent in the low resolution mode.

SUMMARY

The present invention was made to solve the problems above. An object of the present invention is to provide a signal output device for a display device, capable of reducing power consumption more drastically.

To attain the object above, a signal output device of the present invention (hereinafter the present output device) for supplying image signals to source lines of a display device via an image line includes a bypass section which connects a predetermined number of the source lines with one another, so that the image signal to one of the predetermined number of the source lines is simultaneously supplied to all of the predetermined number of the source lines.

The present output device is used in a liquid crystal display device, an EL (Electro Luminescence) display device, a plasma display device, and the like.

The display device above displays an image by supplying image signals, via source lines, to pixels provided on a display screen.

The present output device supplies an externally supplied image signal (a video signal, a still picture signal, and the like) via the image lines to the source lines of the above display devices.

In particular, the present output device includes a bypass section for connecting a predetermined number of the source lines with one another. The output device of the present invention is adapted to simultaneously supply, via the bypass section, the image signal to these source lines, using the image signal to one of the connected source lines.

Thus, the present output device is capable of indirectly supplying, via the bypass section, the image signal to these source lines, using the image signal to one of the connected source lines.

In this manner, the present output device is capable of simultaneously supplying a single image signal to a plurality of source lines. It is therefore possible to simultaneously transmit the image signal to a plurality of pixels, thereby increasing the operating speed of image display. Moreover, provided that the operating speed is not changed, a driving frequency can be lowered. This enables power consumption to be reduced.

Furthermore, the present output device is capable of transmitting the image signal on fewer image lines than the number of source lines that are simultaneously used for display, because the bypass section allows the signal to be transmitted between the source lines.

As a result, the display device can attain much lower power consumption than that expected from the size (the number of source lines, and the like) of the display device.

Moreover, using the present output device in a display device, it is possible to realize a display device capable of supplying image signals into source lines with low power consumption.

For a fuller understanding of the nature and advantages of the invention, reference should be made to the ensuing detailed description taken in conjunction with the accompanying drawings.

DESCRIPTION OF THE EMBODIMENTS

The following describes an embodiment of the present invention.

Figure 2:
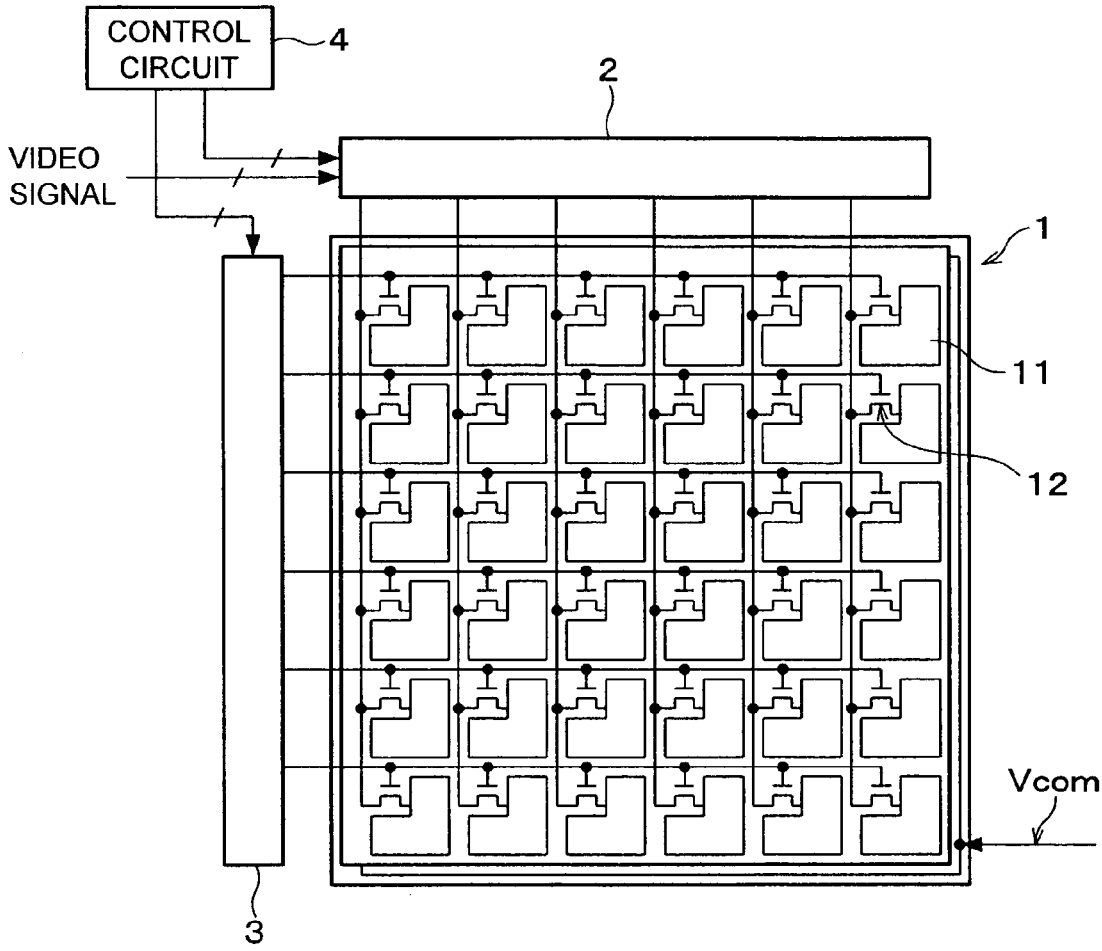
FIG. 2 is an explanatory diagram illustrating an arrangement of the liquid crystal display device.

FIG. 2 is an explanatory diagram illustrating an arrangement of a liquid crystal display device (present display device) according to the present embodiment.

The present display device is capable of performing color display. In the present embodiment, in order to clearly explain a features of the present invention, the present display device is shown as a monochrome (single-color displaying type) display device, having only one channel, in which a single liquid crystal cell (picture element) makes up one pixel.

As used herein, the term "picture element" is a dot (light emitting portion) of a displayed screen, and the "pixel" is a color region composed of a predetermined number of picture elements.

The "channel" is a color displaying component of the present display device, provided for each color to be displayed. The channel includes source lines and picture elements for displaying a color.

As shown in FIG. 2, the present display device includes a liquid crystal panel 1, a source driver 2, a gate driver 3, and a control circuit 4.

The present display device is so arranged that the liquid crystal panel 1, the source driver 2, the gate driver 3, and the control circuit 4 are monolithically mounted on a CG (Continuous Grain) substrate (not shown).

The liquid crystal panel (display panel) 1 includes liquid crystal cells (picture elements) 11 arrayed in a matrix. The liquid crystal panel 1 displays an image by the liquid crystal cells 11.

Figure 3:
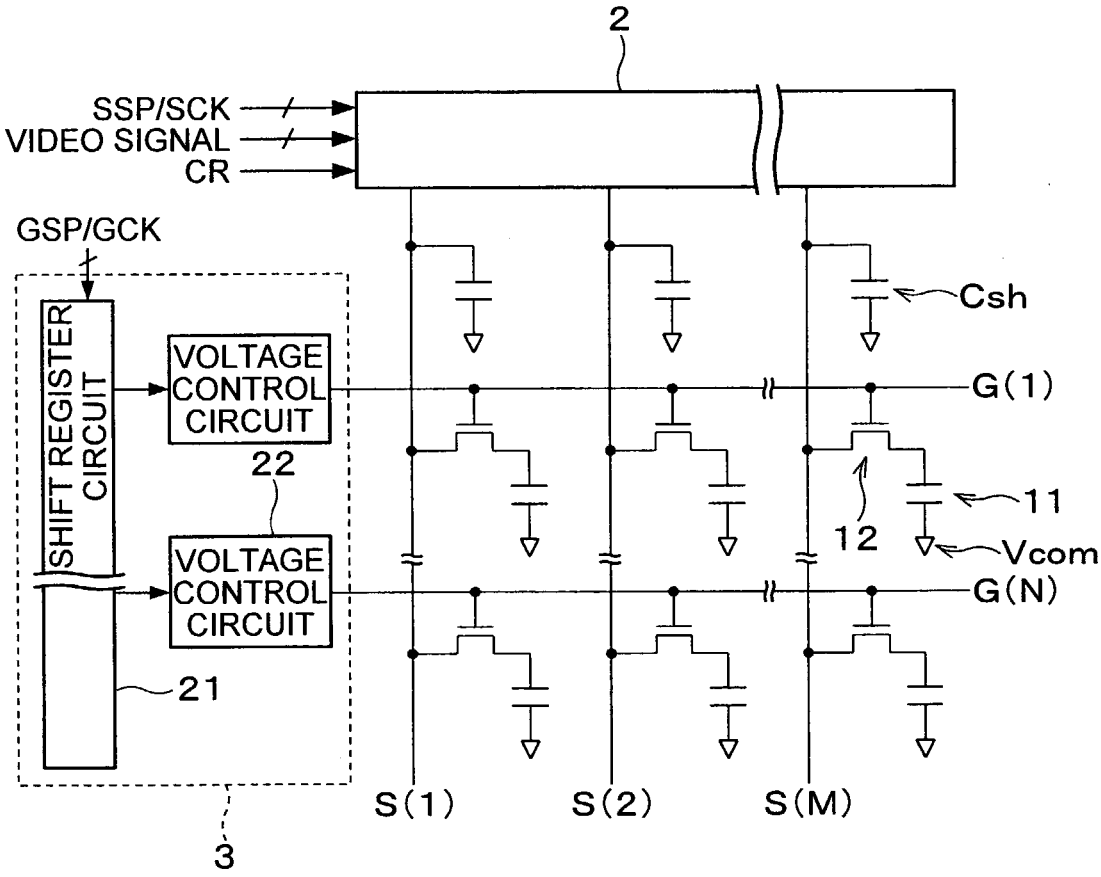
FIG. 3 is an explanatory diagram illustrating an arrangement of a liquid crystal panel, a source driver, and a gate driver in the liquid crystal display device shown in FIG. 2.

FIG. 3 is an explanatory diagram illustrating an arrangement of the liquid crystal panel 1, the source driver 2, and the gate driver 3. As shown in the figure, the liquid crystal panel 1 includes M number of source lines S(1) to S(M) that are disposed in parallel in a vertical direction (column direction) and N number of gate lines G(1) to G(N) that are disposed in parallel in a horizontal direction (row direction), where M and N are natural numbers.

The source lines S(1) to S(M) and the gate lines G(1) to G(N) are disposed orthogonal to each other in a lattice pattern within the liquid crystal panel 1.

In the liquid crystal panel 1, intersections between the source lines S(1) to S(M) and the gate lines G(1) to G(N) are arrayed in a matrix. At each intersection, the liquid crystal cell 11 is formed. In short, the liquid crystal panel 1 is so arranged that the liquid crystal cells 11 are arrayed in a matrix.

Each of the liquid crystal cells 11 has a TFT 12, and counter electrodes (not shown), which are provided opposite the liquid crystal cells 11.

The TFT 12 is a switch for driving the liquid crystal cell 11, and the TFTs 12 are respectively connected to the source lines S(1) to S(M) and to the gate lines G(1) to G(N). The TFTs 12 are driven by voltage signals that are supplied from the source lines S(1) to S(M) and from the gate lines G(1) to G(N).

To the counter electrodes, a common electrode voltage Vcom is applied.

The gate lines G(1) to G(N) are signal lines that carry voltage signals (gate signals) for switching gates of the TFTs 12 (between ON (selected) state and OFF (non-selected) state).

The source lines S(1) to S(M) are signal lines that carry voltage signals (video signals) to the liquid crystal cells 11 via the TFTs 12.

The video signals are picture signals (image signals) for a moving picture to be displayed in the present display device. The present display device is so set that an externally supplied video signal (original video signal) is split (resolved) into four signals by such as serial-parallel conversion.

In the vicinity of respective ends of the source lines S(1) to S(M are shown sampling capacitors Csh. The sampling capacitors Csh are equivalent circuits of respective capacitors of the source lines S(1) to S(M).

The gate driver 3 is a driver (vertical driving circuit) for driving the gate lines G(1) to G(N).

The gate driver 3 receives a GSP signal and a GCK signal from the control circuit 4. In accordance with the GSP signal and the GCK signal, the gate driver 3 generates a gate signal (gate driving pulse), and sequentially applies the gate signal to the gate lines G(1) to G(N), that is, sequentially selects (scans) the gate lines G(1) to G(N).

In this way, the gate signal for controlling ON/OFF of the TFTs 12 is applied to the gate electrodes of the TFTs 12 respectively connected to the gate lines G(1) to G(N).

The GSP signal is a timing pulse supplied to the gate driver 3 in every cycle (every vertical period) of a vertical synchronizing signal. The GCK signal is a clock signal (gate clock signal) for the gate driver 3.

In order to apply the gate signal to the gate lines G(1) to G(N) as described above, the gate driver 3 includes, as shown in FIG. 3, a shift register 21 and voltage control circuits 22.

The shift register 21 sequentially transmits the GSP signal, which is supplied from the control circuit 4, to the voltage control circuits 22 respectively provided at ends of the gate lines G(1) to G(N).

Each of the voltage control circuits 22 includes a level shift circuit (not shown) and a buffer circuit (not shown).

The level shift circuit of the voltage control circuit 22 generates the gate signal by amplifying the GSP signal transmitted from the shift register 21. The buffer circuits respectively apply the generated gate signals to the gate lines G(1) to G(N), that is, to the gate electrodes of the TFTs 12 respectively connected to the gate lines G(1) to G(N)).

The source driver 2 is a driver (horizontal driving circuit) for driving the source lines S(1) to S(M).

The source driver 2 receives an SSP signal, an SCK signal, and the video signal supplied from the control circuit 4. At the timings of the SSP signal and the SCK signal, the source driver 2 supplies the video signal to the source lines S(1) to S(M), thereby writing the video signal (applying voltages according to the video signals) into the liquid crystal cells 11 selected by the gate driver 3 (that is, those liquid crystal cells 11 in which the gate signal is applied to the gate electrodes of the TFTs 12).

The SSP signal is a timing pulse for causing the source driver 2 to start operating (supplying the video signal). The SCK signal is a clock signal (source clock signal) for the source driver 2.

The source driver 2 also has a function of switching resolutions of a displayed image in accordance with a value of a resolution control signal CR transmitted from the control circuit 4. This function of the source driver 2 is described later.

The control circuit (control section) 4 receives the vertical synchronizing signal, a horizontal synchronizing signal, the original video signal, and the clock signal from an external device (personal computer and the like). In receipt of these signals, the control section 4 converts each of the signals into a form suitable for the source driver 2 and the gate driver 3.

The control circuit 4 then generates, by the conversion, the GCK signal, the SSP signal, the SCK signal, and the video signals (split video signals), and supplies these signals to the source driver 2 and the gate driver 3.

Further, the control circuit 4 varies, in accordance with instructions of a user of the present display device, the value of the resolution control signal CR that is to be supplied to the source driver 2. This function of the control circuit 4 is described later.

Figure 1:
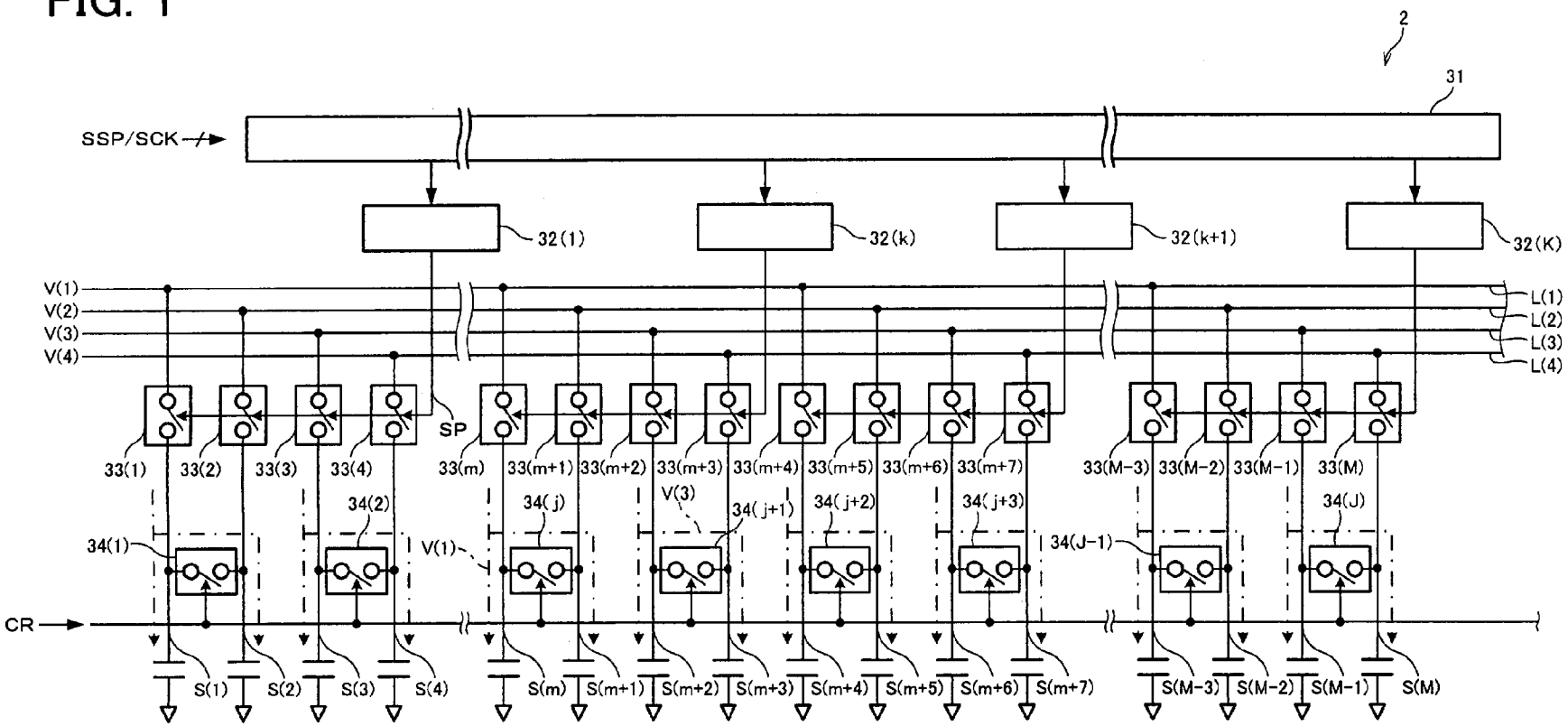
FIG. 1 is an explanatory diagram illustrating an arrangement of a source driver in a liquid crystal display device of an embodiment of the present invention.

FIG. 1 is illustrates an arrangement of the source driver 2.

The source driver 2 has a multi phase function in which four signals are obtained by resolving the original video signal and are respectively transmitted via four lines. The source driver 2 also has a simple function of converting the horizontal resolution. As shown in FIG. 1, the source driver 2 includes a shift register 31, voltage control circuits 32(1) to 32(K), video signal lines L(1) to L(4), sampling switches 33(1) to 33(M), and bypass switches 34(1) to 34(J), where K and J are natural numbers.

The shift register 31 receives the SSP signal from the control circuit 4, and sequentially transmits the SSP signal to the voltage control circuits 32(1) to 32(K).

The voltage control circuits (bypass sections) 32(1) to 32(K) each send a sampling signal SP to a set of an adjacent four of the sampling switches 33(1) to 33(M) of the source lines S(1) to S(M). Thus, as shown in FIG. 1, in the present display device, the four source lines S(m) to S(m+4) belong to the single voltage control circuit 32(*k*), where m and k are natural numbers.

Therefore, the number of the voltage control circuits 32(1) to 32(K) is one fourth of the number of the source lines S(1) to S(M) (that is, K=M/4).

Each of the voltage control circuits 32(1) to 32(K) has a level shift circuit (not shown) and a buffer circuit (not shown).

Each level shift circuit of the voltage control circuits 32(1) to 32(K) generates the sampling signal SP by amplifying the received SSP signal. The buffer circuit applies the generated sampling signal SP to the four sampling switches 33 belonging to the buffer circuit.

The video signal lines (the image lines) L(1) to L(4) carry video signals (split signals) V(1) to V(4), respectively, which have been obtained by resolving the original video signal into four signals. That is, the video signals V(1) to V(4) are respectively applied to the video signal lines L(1) to L(4).

The video signal lines L(1) to L(4) correspond to the source lines S(1) to S(M) at a 1:4 ratio.

Specifically, in the case where the source lines S(m), S(m+4), S(m+8), . . . belong to the video signal line L(1), the source lines S(m+1), S(m+5), S(m+9), . . . , the source lines S(m+2), S(m+6), S(m+10), . . . , and the source lines S(m+3), S(m+7), S(m+11), . . . , respectively belong to the video signal lines L(2), L(3), and L(4).

Between the video signal lines L(1) to L(4) and the source lines S(1) to S(M) belonging thereto are respectively provided the sampling switches 33(1) to 33(M) for controlling connections between the video signal lines L(1) to L(4) and the source lines S(1) to S(M).

The sampling switches 33(1) to 33(M) are analog switches, respectively provided in the vicinity of ends of the source lines S(1) to S(M).

As shown in FIG. 1, as with the source lines S(1) to S(M), four adjacent sampling switches 33(*m*) to 33(m+3) belong to each voltage control circuit 32(*k*).

The sampling switches 33(1) to 33(M) are adapted to connect, in response to the sampling signal SP supplied from the voltage control circuits 32(1) to 32(*k*), the video signal lines L(1) to L(4) with the source lines S(1) to S(M) belonging thereto.

The bypass switches (the bypass section) 34(1) to 34(J) are analog switches that are provided between every other adjacent two of the source lines S(1) to S(M). As shown in FIG. 1, a pair of adjacent source lines S(m) and S(m+1) belong to the bypass switch 34(*j*), which is disposed between the source lines S(m) and S(m+1), where j is a natural number. Therefore, the number of the bypass switches 34(1) to 34(J) is half the number of the source lines S(1) to S(M) (that is, J=M/2).

The bypass switches 34(1) to 34(J) have a function of receiving a resolution control signal CR supplied from the control circuit 4 and controlling, in accordance with a value of the resolution control signal CR, a connection between adjacent two of the source lines S(1) to S(M) on the both sides of each bypass switch.

That is, the bypass switches 34(1) to 34(J) are capable of connecting two of the source lines S(1) to S(m) on the both sides of each bypass switch in parallel.

The following describes displaying operations of the present display device.

The present display device is capable of selectively carrying out display in a high resolution mode or a low resolution mode, according to input user instructions.

In the high resolution mode, individual video signals are applied to all the pixels of the present display device. In other words, in the high resolution mode, the source lines S(1) to S(M) of the source driver 2 respectively receive individual video signals according to an image to be displayed.

In the low resolution mode, on the other hand, the source lines S(1) to S(M) are divided into pairs (M/2), and the video signal is individually supplied to each pair. Therefore, in the low resolution mode, adjacent two of the source lines S(1) to S(M) receive the same video signal.

The operation of the present display device in the high resolution mode is described below.

In the high resolution mode, the control circuit 4 supplies the resolution control signal CR according to the high resolution mode to the bypass switches 34(1) to 34(J) of the source driver 2. The resolution control signal CR that is thus supplied turns OFF the bypass switches 34(1) to 34(J) and disconnects two of the source lines S(1) to S(M) on the both sides of each bypass switch.

The control circuit 4 generates four different video signals V(1) to V(4) by splitting the externally supplied original video signal, and independently supplies the video signals V(1) to V(4) to the video signal lines L(1) to L(4).

In the source driver 2, the voltage control circuit 32(1) simultaneously turns ON the first four sampling switches 33(1) to 33(4) of the sampling switches 33(1) to 33(*m*), at a predetermined timing in accordance with the SSP signal and the SCK signal, so as to connect the video signal lines L(1) to L(4) with the source lines S(1) to S(4) belonging thereto. As a result, the four different video signals V(1) to V(4) are simultaneously supplied to the source lines S(1) to S(4), respectively.

At a rising timing of the next SCK signal, the voltage control circuit 32(1) turns OFF the sampling switches 33(1) to 33(4). Then, the voltage control circuit 32(2) of the next stage simultaneously turns ON the next four sampling switches 33(5) to 33(8), and simultaneously supplies, in the above-described manner, the video signals V(1) to V(4) to the source lines S(5) to S(8), respectively.

Likewise, the four different video signals V(1) to V(4) are respectively supplied to every four source lines S(m) to S(m+3).

Next, the operation of the present display device in the low resolution mode is described below.

In the low resolution mode, the control circuit 4 supplies the resolution control signal CR according to the low resolution mode to the bypass switches 34(1) to 34(J) of the source driver 2. The resolution control signal CR that is thus supplied turns ON the bypass switches 34(1) to 34(J), and connects two of the source lines S(1) to S(M) on the both sides of each bypass switch.

The control circuit 4 generates two different video signals V(1) and V(3), which are obtained by splitting the original video signal. Then, the control circuit 4 independently supplies the video signals V(1) and V(3) to the video signal lines L(1) and L(3).

At this time, the video signal lines L(2) and L(4) receive no video signal (in other words, the video signal lines L(2) and L(4) are OFF (Hi-Z)).

In the source driver 2, as in the high resolution mode, the voltage control circuit 32(1) simultaneously turns ON the sampling switches 33(1) to 33(4) at a predetermined timing in accordance with the SSP signal and the SCK signal so as to connect the video signal lines L(1) to L (4) with the source lines S(1) to S(4) belonging thereto.

Thus, as shown by the chain line in FIG. 1, the video signal V(1) is supplied to the source line S(1), and also to the source line S(2) via the bypass switch 34(1).

Likewise, the video signal V(3) is supplied to the source line S(3), and also to the source line S(4) via the bypass switch 34(2).

At a rising timing of the next input of the SCK signal, the voltage control circuit 32(1) turns OFF the sampling switches 33(1) to 33(4). Then, the voltage control circuit 32(2) of the next stage simultaneously turns ON the next four sampling switches 33(5) to 33(8), and simultaneously supplies, in the above-described manner, the video signals V(1) and V(3) into the source lines S(5) to S(8).

Likewise, the two different video signals V(1) and V(3) are subsequently supplied to every four source lines S(m) to S(m+3).

As described above, the present display device includes the bypass switch 34 that connects a predetermined number of source lines S with one another. The bypass switch 34 is adapted so that, in the low resolution mode, the video signal V that is supplied to one of the interconnected source lines S is simultaneously supplied to the rest of the source lines S via the bypass switch 34, all at the same time.

Thus, the present display device is capable of supplying the video signal V that is supplied to one of the interconnected source lines S, indirectly to the rest of the source lines S via the bypass switch 34.

As a result, the present display device is capable of supplying the same video signal V to a plurality of source lines S simultaneously. Therefore, it is possible to simultaneously transmit the video signal V to a plurality of liquid crystal cells 11 disposed in a horizontal direction, thereby increasing the operating speed of displaying an image. Moreover, a driving frequency can be lowered, provided that the operating speed is not changed. This enables power consumption to be lowered.

Furthermore, by the provision of the bypass switch 34 that transmits the signal between the source lines S, the present display device requires a relatively smaller number of video signal lines L for actually transmitting the video signals V, with respect to the number of source lines S that are simultaneously used to carry out display.

As a result, it is possible to attain significantly lower power consumption than that expected from the size (the number of source lines S and the like) of the present display device.

The present display device includes a plurality of video signal lines L for transmitting the video signals V to the source lines S. The present display device is adapted to connect the signal lines L with the identical number of source lines S, in groups, so as to simultaneously supply the video signals V to the source lines S of each group. In this way, it is possible to simultaneously supply different kinds of video signals V to the liquid crystal cells 11 belonging to a plurality of source lines S.

Further, in the present display device, the video signal V supplied to each video signal line L is obtained by performing multi phase process of the original video signal. This reduces the amount of information (a frequency characteristic) per video signal line L, making it possible to easily increase the operating speed of the display device.

The present display device is adapted so that the control circuit 4 performs the multi phase of the original video signal. The control circuit 4 is adapted to generate, by the multi phase, the video signals V in a number smaller than the number of the video signal lines L, and the control circuit 4 respectively outputs the video signals V to the identical number of the video signal lines L.

The control circuit 4 controls the bypass switch 34 so as to connect the source line S connected to the video signal lines L to which the video signal V has been supplied with the source line S of the video signal line L to which the video signal V was not supplied.

In this way, the number of video signal lines L to which the video signals V are actually applied can be made fewer than the number of source lines that simultaneously receive the video signals V. As a result, it is possible to attain significantly lower power consumption.

In the high resolution mode, the control circuit 4 generates, by the multi phase, the video signals V in a number which is equal to the number of video signal lines L, and the control circuit 4 respectively supplies the video signals V to the video signal lines L. Here, the control circuit 4 prevents the bypass switches 34 from connecting the source lines S to each other.

The control circuit 4 switches the low resolution mode and the high resolution mode in accordance with user's instructions. Thus, the user can view a displayed image at desired resolutions.

Note that, in the present embodiment, the control circuit 4 in the low resolution mode generates two different video signals V(1) and V(3) by splitting the original video signal, and supplies the video signals V(1) and V(3) to the video signal lines L(1) and L(3), respectively. However, not limiting to this, the control circuit 4 may generate video signals V(2) and V(4) by splitting the externally supplied original video signal, and supplies the video signals V(2) and V(4) to the source driver 2.

Further, in the present embodiment, four of the source lines S(1) to S(M) belong to each one of the voltage control circuits 32(1) to 32(K). However, the number of the source lines S(1) to S(M) belonging to each of voltage control circuits 32(1) to 32(K) is not limited to four; it may be less than four, or more than four.

Further, in the present embodiment, in the low resolution mode, adjacent two of the source lines among the source lines S(1) to S(M) receive the same video signal. However, not limiting to this, the control circuit 4 in the low resolution mode may simultaneously turn ON two adjacent gate lines of the gate lines G(1) to G(N). In this case, the video signal for one pixel is simultaneously written into four of the liquid crystal cells 11, which makes it possible to increase the operating speed nearly four times faster. Moreover, provided that the operating speed is not changed, the driving frequency can be reduced to one-fourth, thereby significantly reducing power consumption.

Further, in the low resolution mode, the control circuit 4 may supply the same video signal to three or more adjacent source lines of the source lines S(1) to S(M). Alternatively, the control circuit 4 may simultaneously turn ON three or more adjacent gate lines of the gate lines G(1) to G(N).

Further, in the present embodiment, the control circuit 4 in the low resolution mode generates the two different video signals V(1) and V(3) by splitting the original video signal, and supplies the video signals V(1) and V(3) to the video signal lines L(1) and L(3), respectively, while no video signal is supplied to the video signal lines L(2) and L(4). However, in the low resolution mode, the video signal lines L(1) and L(3) and the video signal lines L(2) and L(4) may be used alternately.

Figure 4:
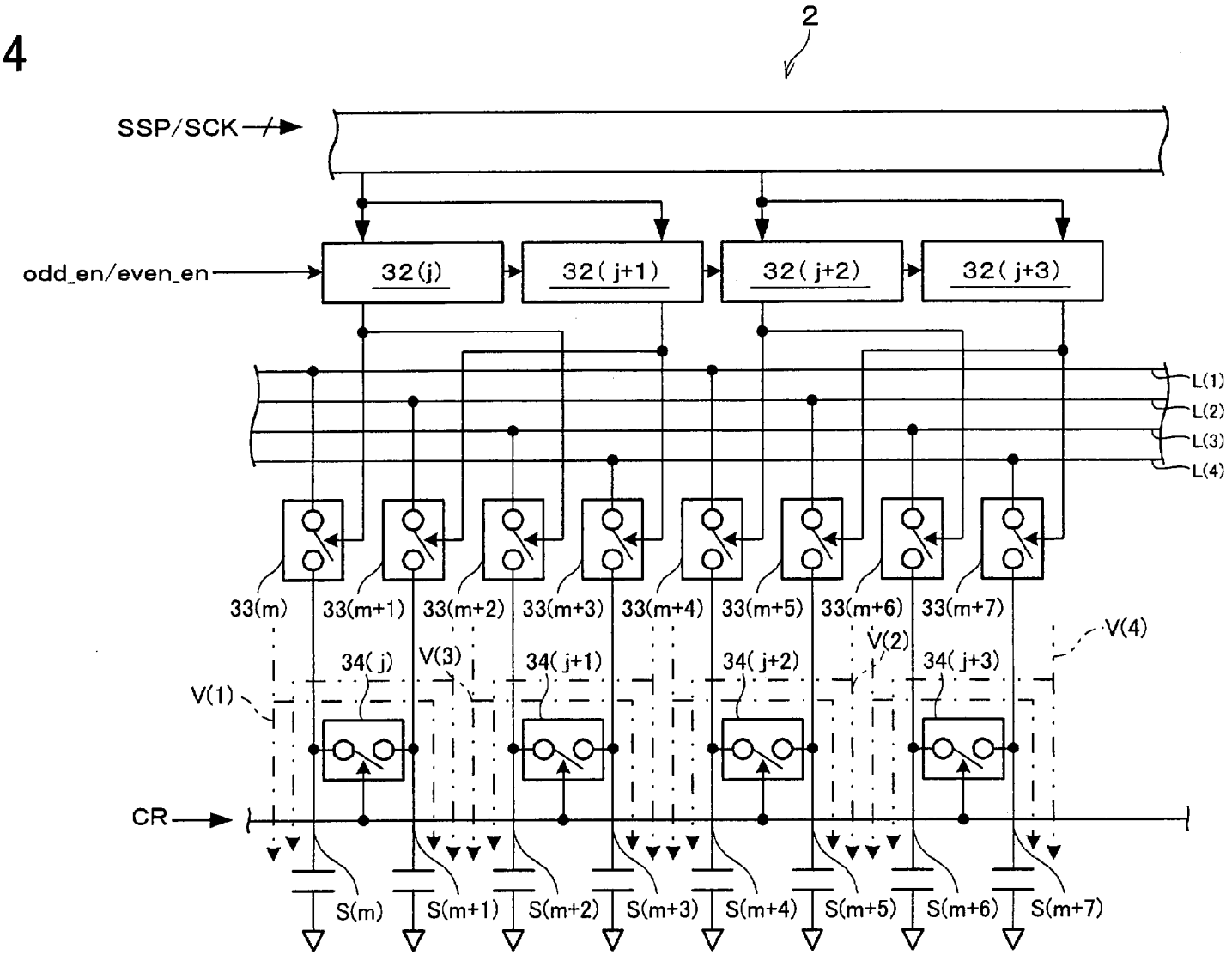
FIG. 4 is an explanatory diagram illustrating another arrangement of the source driver in the liquid crystal display device shown in FIG. 2.

FIG. 4 is an explanatory diagram showing this arrangement. The arrangement shown in FIG. 4 differs from that of FIG. 1 in that every two alternate source lines of the source lines S(m) to S(m+7) belong to the voltage control circuits 32(*j*) to 32(j+3), respectively. In other words, the two source lines S(m) and S(m+1), which are associated with each other by the bypass switch 34(*j*), respectively belong to the two different voltage control circuits 32(*j*) and 32(j+1).

The following describes displaying operations according to this arrangement.

In the high resolution mode, the control circuit 4 supplies the resolution control signal CR according to the high resolution mode to the bypass switches 34(*j*) to 34(j+3) of the source driver 2. The resolution control signal CR so supplied turns OFF the bypass switches 34(*j*) to 34(j+3), so as to disconnect two of the source lines S(m) to S(m+7) o the both sides of the bypass switch.

The control circuit 4 generates four different video signals V(1) to V(4) by splitting the externally supplied original video signal. Then, the control circuit 4 independently supplies the video signals V(1) to V(4) to the video signal lines L(1) to L(4), respectively.

In the source driver 2, the voltage control circuits 32(*j*) and 32(j+1) simultaneously turn ON the sampling switches 33(*m*) to 33(m+3), at a predetermined timing in accordance with the SSP signal and the SCK signal, so as to connect the video signal lines L(1) to L(4) with the source lines S(m) to S(m+3) belonging thereto. As a result, the four different video signals V(1) to V(4) are simultaneously supplied to the source lines S(m) to S(m+3), respectively.

At a rising timing of the next input of the SCK signal, the voltage control circuits 32(*j*) and 32(j+1) simultaneously turn OFF the sampling switches 33(*m*) to 33(m+3). Then, the next voltage control circuits 32(j+2) and 32(j+3) simultaneously turn ON the next four sampling switches 33(m+4) to 33(m+7), so as to simultaneously supply, in the above-described manner, the video signals V(1) and V(4) to the source lines S(m+4)to S(m+7), respectively.

Next, the operation of the display device in the low resolution mode is described below.

In the low resolution mode, the control circuit 4 supplies the resolution control signal CR according to the low resolution mode to the bypass switches 34(*j*) to 34(j+3) of the source driver 2. The resolution control signal CR so supplied turns ON the bypass switches 34(*j*) to 34(j+3) so as to connect two of the source lines S(m) to S(m+7) on the both sides of the bypass switch.

The control circuit 4 generates two different video signals V(1) and V(3) by splitting the original video signal. Then, the control circuit 4 independently supplies the video signals V(1) and V(3) to the video signal lines L(1) and L(3), respectively. At this time, no video signal is supplied to the video signal lines L(2) and L(4).

In the source driver 2, as in the high resolution mode, the voltage control circuit 32(*j*) simultaneously turns ON the sampling switches 33(*m*) and 33(m+2) at a predetermined timing in accordance with the SSP signal and the SCK signal. Then, the voltage control circuit 32(*j*) connects the video signal lines L(1) and L(3) with the source lines S(m) to S(m+2) belonging thereto, respectively.

As a result, as indicated by the dashed-dotted line in FIG. 4, the video signal V(1) is supplied to the source line S(m). The video signal V(1) is also supplied to the source line S(m+1) via the bypass switch 34(*j*).

Likewise, the video signal V(3) is supplied to the source line S(m+2), and also to the source line S(m+3) via the bypass switch 34(j+1).

At a rising timing of the next input of the SCK signal, the voltage control circuit 32(*j*) turns OFF the sampling switches 33(*m*) and 33(m+2). Then, the voltage control circuit 32(j+2) simultaneously turns ON the two sampling switches 33(m+4) and 33(m+6), so as to simultaneously supply, in the above-described manner, the video signals V(1) and V(3) to the source lines S(m+4) to (m+7).

Then, after scanning for a horizontal time period (or a vertical time period), the control circuit 4 generates two different video signals V(2) and V(4) by splitting the original video signal. The control circuit 4 then independently supplies the video signals V(2) and V(4) to the video signal lines L(2) and L(4), respectively. At this time, no video signal is supplied to the video signal lines L(1) and L(3).

In the source driver 2, as in the high resolution mode, the voltage control circuit 32(j+1) simultaneously turns ON the sampling switches 33(m+1) and 33(m+3) at a predetermined timing in accordance with the SSP signal and the SCK signal, so as to connect the video signal lines L(2) and L (4) with the source lines S(m+1) and S(m+3) belonging thereto, respectively.

Thus, as indicated by the double dotted dashed line in FIG. 4, the video signal V(2) is supplied to the source line S(m+1). The video signal V(2) is also supplied to the source line S(m) via the bypass switch 34(*j*).

Likewise, the video signal V(4) is supplied to the source line S(m+3), and also to the source line S(m+2) via the bypass switch 34(j+1).

At a rising timing of the next input of the SCK signal, the voltage control circuit 32(j+1) turns OFF the sampling switches 33(m+1) and 33(m+3). Then, the voltage control circuit 32(j+3) simultaneously turns ON the two sampling switches 33(m+5) and 33(m+7), so as to simultaneously supply, in the above-described manner, the video signals V(2) and V(4) to the source lines S(m+4) to S(m+7), respectively.

In this manner described above, with the arrangement shown in FIG. 4, it is also possible to attain significantly lower power consumption, as in the arrangement of FIG. 1.

In the described arrangement, the control circuit 4 switches, in every horizontal time period (or every vertical time period), the source lines S(m) to which the video signals are supplied, so as to reverse the direction of signal flow in the bypass switch 34(*j*).

In the arrangement in FIG. 1, if there is ON resistance in the bypass switch 34, an amount of electrical charge may differ between the liquid crystal cell 11 that receives the signal transmitted via the bypass switch 34 and the liquid crystal cell 11 that receives the signal transmitted without passing through the bypass switch 34. In such a case, there is a possibility that vertical stripes (vertical lines) appear on the displayed screen, thereby damaging display quality.

In the arrangement in FIG. 4, on the other hand, because the direction of signal flow in the bypass switch 34(*j*) is reversed in every vertical time period (or horizontal time period), the influence of the ON resistance in the bypass switch on each of the liquid crystal cell 11 can be averaged in terms of time. Thus, it is possible to prevent the vertical stripes from appearing, thereby preventing deterioration of display quality.

Figure 5:
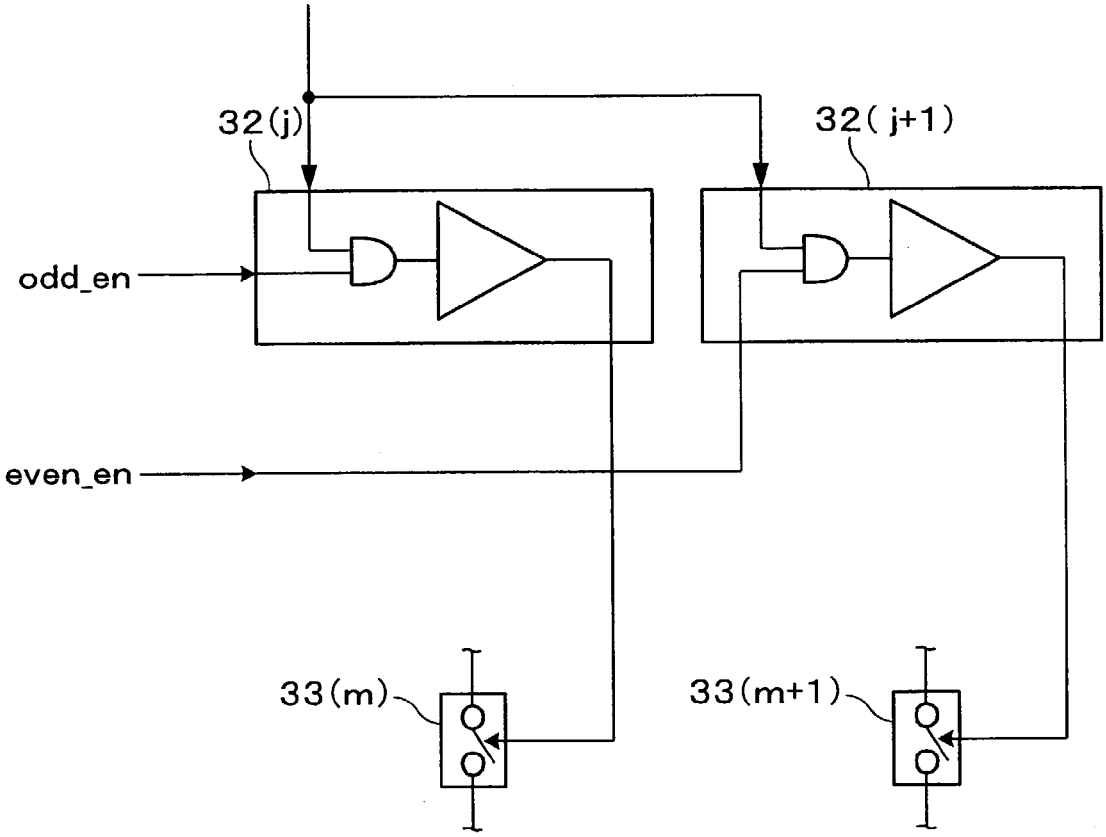
FIG. 5 is a block diagram illustrating an arrangement of a voltage control circuit of the source driver shown in FIG. 4.

FIG. 5 is a block diagram illustrating an arrangement of the voltage control circuit 32(*j*) of the source driver 2 shown in FIG. 4. The source driver 2 shown in FIG. 4 is so arranged that the voltage control circuit 32(*j*) selected by a buffer selecting signal supplied from the control circuit 4 turns ON the sampling switch 33(*m*) belonging thereto.

The source driver 2 shown in FIG. 4 is adapted so that a buffer selecting signal (odd_en) is supplied to the odd number voltage control circuit 32(*j*), and a buffer selecting signal (even_en) is supplied to the even number voltage control circuit 32(j+1). In the high resolution mode, the buffer selecting signal (odd_en) and the buffer selecting signal (even_en) are controlled at high level (H), for example, so that both of the voltage control circuits 32(*j*) and 32(j+1) become effective (the sampling switches 33 belonging thereto are turned ON).

In the low resolution mode, on the other hand, the buffer selecting signal (odd_en) and the buffer selecting signal (even_en) are so controlled that the voltage control circuits 32(*j*) and 32(j+1) alternately become effective in every horizontal time period (or vertical time period). Specifically, the buffer selecting signal (even_en) becomes low level (L) when the buffer selecting signal (odd_en) is high level. The buffer selecting signal (even_en) becomes high level when the buffer selecting signal (odd_en) is low level.

Figure 6:
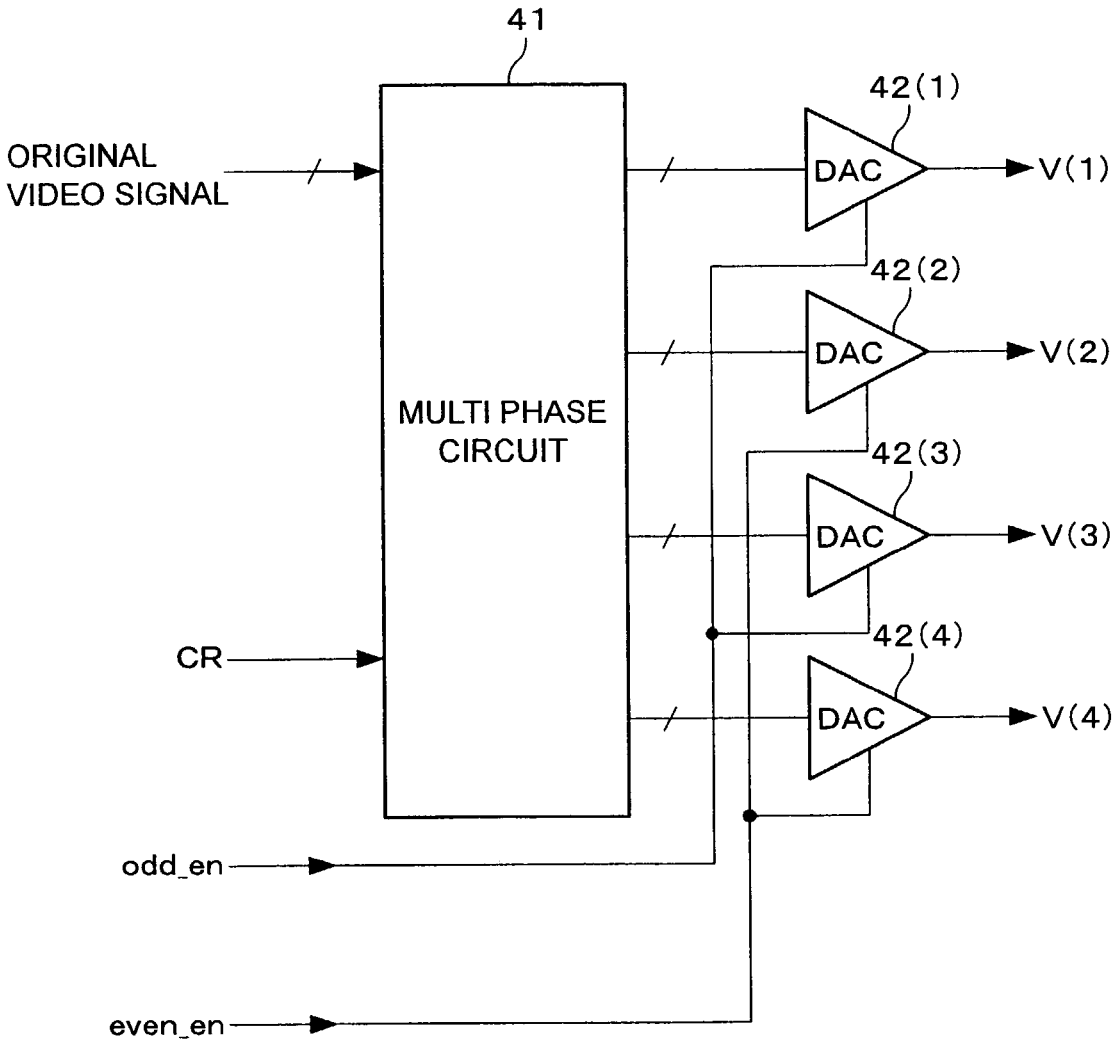
FIG. 6 is a block diagram illustrating an arrangement of a control circuit in the liquid crystal display device shown in FIG. 2.

FIG. 6 is a block diagram illustrating an arrangement of the control circuit 4 of the present display device. As shown in FIG. 6, the control circuit 4 includes a multi phase circuit 41 and four DAC sections 42(1) to 42(4).

The multi phase circuit 41 (control section; multi phase circuit with four/two-signal selecting function) has a function of splitting the externally supplied video signal in accordance with the resolution control signal CR generated by another circuit (not shown) in the control circuit 4, so that the input video signal is split into four signals in the high resolution mode and into two signals in the low resolution mode.

In the high resolution mode, the multi phase circuit 41 respectively supplies the four video signals V(1) to V(4) to the four DAC sections 42(1) to 42(4).

In the low resolution mode, on the other hand, the multi phase circuit 41 supplies the video signal V(1) (or the video signal V(2)) to the DAC sections 42(1) and 42(2), and supplies the video signal V(3) (or the video signal V(4)) to the DAC sections 42(3) and 42(4).

Each of the DAC sections 42(1) and 42(3) has a terminal for receiving the video signal and a terminal (a power saving terminal) for receiving the buffer selecting signal (odd_en).

On the other hand, each of the DAC sections 42(2) and 42(4) has a terminal for receiving the video signal and a terminal (a power saving terminal) for receiving the buffer selecting signal (even_en).

The DAC sections 42(1) to 42(4) are adapted to supply, to the video signal lines L(1) to L(4), the video signals supplied from the multi phase circuit 41, only when the high-level buffer selecting signal is inputted, for example.

The control circuit 4 shown in FIG. 6 is also capable of supplying the video signals to the source driver 2 shown in FIG. 1. In this case, the DAC sections 42(1) to 42(4) always receive the high level buffer selecting signal (odd_en) and the low level buffer selecting signal (even_en). When the video signal lines L(2) and L(4) are used, the DAC sections 42(1) to 42(4) always receive the high level buffer selecting signal (even_en) and the low level buffer selecting signal (odd_en).

In the present embodiment, the source driver 2 supplies the video signals (image signals) for a moving picture to the source lines S(1) to S(M) of the liquid crystal panel 1. However, the source driver 2 may supply the image signals for a still picture to the source lines S(1) to S(M).

In the present embodiment, the liquid crystal panel 1, the source driver 2, the gate driver 3, and the control circuit 4 are monolithically mounted on a CG silicon substrate. However, the monolithic construction is not necessary, and the source and gate drivers 2 and 3, or the control circuit 4 may be mounted on a separate substrate. In other words, the source and gate drivers 2 and 3, or the control circuit 4 may be externally provided.

Further, the substrate of the present display device may be made of, for example, polysilicon or amorphous silicon, other than the CG silicon.

In the present embodiment, the present display device is a liquid crystal display device that includes the liquid crystal panel 1. However, the present display device may be an EL (Electro Luminescence) display device or a plasma display device, by replacing the liquid crystal panel of the present display device with an EL panel or a plasma display panel.

Also in the present embodiment, the present display device includes the matrix-type liquid crystal panel 1. In the matrix-type display device referred herein, a pixel (display cell) is provided at each intersection of gate lines that are disposed in parallel in one direction (the vertical direction) and source lines that are disposed in the direction (the horizontal direction) orthogonal to the gate lines. The matrix-type display device displays an image by supplying, via the source lines, image signals to the pixels that are sequentially selected by the gate lines.

However, the display panel of the present display device is not limited to the matrix-type display device. For example, the liquid crystal panel 1 may be replaced with a segment-type (segment electrode type) display panel (liquid crystal panel and the like; multiplex driving or static driving), in which each display portion (optical switch) has an independent electrode. In the segment-type display panel, electrode lines respectively extending to the electrodes are used as source lines.

In the present embodiment, each of the voltage control circuits 32(1) to 32(K) includes the level shift circuit (not shown) and the buffer circuit (not shown). The buffer circuit is for driving the sampling switches 33(1) and 33(M), and may be realized by, for example, a current amplifier. The buffer circuit may also be realized by means for adjusting a width of an output waveform of the shift register 31. Further, the buffer circuit may be realized by means for amplifying the current and adjusting a width of an output waveform.

Moreover, it is not necessary to provide the buffer circuit in the voltage control circuits 32(1) to 32(K). Without the buffer circuit, the voltage control circuits 32(1) to 32(K) do not function as the buffer, and merely select whether or not to supply video signals.

Further, in the present embodiment, the four video signal lines L(1) to L(4) are provided, and that the video signals are simultaneously supplied to the four source lines S(1) to S(M). However, the number of the video signal lines may be smaller than the number of source lines that receive the video signals (the number of video signal lines may be two, for example). If the number of video signal lines is two, the bypass switches 34(1) to 34(J) are always ON, and the displaying mode is always the low resolution mode.

In the present embodiment, it is the control section 4 that generates the resolution control signal CR to be supplied to the sampling switches 33(1) to 33(M) and the like. However, the resolution control signal CR may be externally supplied.

In one aspect of the invention, the present invention is an image signal output device for supplying image signals to source lines of a matrix-type display device, wherein the image signal output device includes a multi phase section that splits the externally supplied image signal, so as to generate i number of split signals, and a signal output section that outputs the i number of split signals to i number of image lines, the image signals being simultaneously supplied to the i number of source lines respectively connected to the i number of image lines, where i is a natural number.

In one aspect of the invention, the present invention is an image signal output device for supplying image signals to source lines of a matrix-type display device, wherein the image signal output device includes a multi phase section that splits the externally supplied image signal, so as to generate a plurality of split signals, and a signal output section that outputs the split signals to a plurality of image lines, the image signals being simultaneously supplied to groups of the source lines that are respectively connected to the image lines.

In one aspect of the invention, the present invention is a signal output device for supplying image signals to source lines of a matrix-type display device, the signal output device performing multi phase process of an original image signal so as to generate a plurality of split signals, and supplying the split signals to a plurality of image lines, and respectively connecting the image lines with the identical number of the source lines in groups, so as to simultaneously supply the image signals to the signal lines of each group, wherein the signal output device includes a multi phase section that splits the image signal so as to generate the plurality of split signals and supplies the split signals to the plurality of image lines, a bypass section that connects a predetermined number of the source lines with one another so as to simultaneously supply the image signal to these source lines, using the image signal to one of the source lines, and a control section that controls the multi phase section so as to generate a fewer split signals than the image lines and supply the split signals to the identical number of image lines, and the control section controls the bypass section to connect the source lines of the image line which has received the split signal, with the source line connected to the image line that did not receive the split signal.

In one aspect of the invention, the present invention is a signal output device for supplying image signals to source lines of a matrix-type display device via image lines, including a bypass section for connecting a predetermined number of the source lines with one another so as to simultaneously supply the image signals to the predetermined number of the source lines, using the image signal to one of the predetermined number of the source lines, wherein the image lines are respectively connected to the identical number of the source lines in groups, so as to simultaneously supply the image signals to the source lines of each group, and the signal output device further includes: a multi phase section that splits an image signal so as to generate a plurality of split signals and supplying the split signals to a plurality of image lines; and a control section for causing the multi phase section to generate a smaller number of split signals than the number of the image lines and to the identical number of the image lines, and the control section causing the bypass section to connect the source line connected to the image line which has received the split signal, with the source line connected to the image line which did not receive the split signal.

In one aspect of the invention, the present invention is a signal output method for supplying image signals to source lines of a matrix-type display device, in which an image signal is split so as to generate a plurality of split signals, and the split signals are supplied to a plurality of image lines, the image signal being supplied to groups of source lines which are equal in number to the image lines, so as to simultaneously supply the image signal to the source lines of each group, wherein the method includes the steps of splitting the image signal so as to generate a fewer split signals than the image lines, and supplying the split signals to the identical number of image lines, and connecting a predetermined number of the source lines with one another, so that the image signal to one of the predetermined number of the source lines is simultaneously supplied to all of the predetermined number of the source lines.

The present output device is a signal output device for supplying image signals to source lines of a display device via an image line, including a bypass section which connects a predetermined number of the source lines with one another, so that the image signal to one of the predetermined number of the source lines is simultaneously supplied to all of the predetermined number of the source lines.

In other words, the present output device is a signal output device for supplying image signals to source lines of a display device via an image line, including a bypass section which connects a predetermined number of the source lines with one another so as to simultaneously supply the image signal to the predetermined number of the source lines, using the image signal to one of the predetermined number of the source lines.

Further in other words, the present output device is a signal output device for supplying image signals to source lines of a display device via an image line, including a bypass section which connects a predetermined number of the source lines with one another, so that the image signal to one of these source lines is supplied to a rest of these source lines all at a same time.

According to the present embodiment, it is the control section 4 that performs the signal output process and signal generating process for the source driver 2 or the bypass switches 34(1) to 34(J). However, instead of the control circuit 4, there may be used an information processing device capable of reading a program that is stored in a storing medium to perform such operations, and such a digital signal output device that is controlled by such information processing device.

According to this arrangement, an arithmetic unit, such as a CPU and an MPU, of the information processing device reads the program stored in the storing medium and executes the program, that is, the following processes may be realized by the program itself.

Examples of the information processing device include, other than a common computers (work station, personal computer, and the like), a feature expansion board and a feature expansion unit, which are connected to a computer.

The program is a program code (execute form program, intermediate code program, source program, and the like) of software for realizing the signal output process and the signal generating process. The program may be used alone or in combination with other programs (OS and the like).

The program may be such a kind as to be temporarily stored in a memory (RAM and the like) in the device after being read out of the storing medium, and then read out again and executed.

The storage medium used to store the program may be such a kind as can be easily separated from the information processing device, or such a kind as to be fixed (mounted) on the device. Further, the storing device may be such a kind as to be connected, as an external storing device, to the information processing device.

Examples of such a storing device include: magnetic tapes such as a video tape and a cassette tape; magnetic disks such as a floppy disk (registered trademark) and a hard disk; optical disks (magnetic optical disks) such as a CD-ROM, an MO, an MD, a DVD, and a CD-R; memory cards such as an IC card and an optical card; and semiconductor memories such as a mask ROM, an EPROM, an EEPROM, and a flash ROM.

Further, the storing device may be connected to the information processing device via an network (intranet, the Internet, and the like). In this case, the information processing device downloads the program via the network. In other words, the program may be obtained via a transmission medium (a medium for carrying the program in flux) such as a wired or wireless network. Preferably, a program for downloading the program should be stored in advance within the information processing device or within the present display device.

In the present embodiment, in order to clearly describe the present invention, the present display device is assumed to be a monochrome display type (single-color display type) device of a single channel, in which one liquid crystal cell (picture element) constitutes one pixel.

However, it is possible to realize the present display device as a color liquid crystal display device. In this case, a pixel is constituted by three liquid crystal cells (picture elements) respectively corresponding to three channels (channels of three primary colors R(red), G(green), and B(blue), respectively). The present display device as described above may be regarded as a color display device, which was described with regard to only one of the channels R, G, and B.

Figure 7:
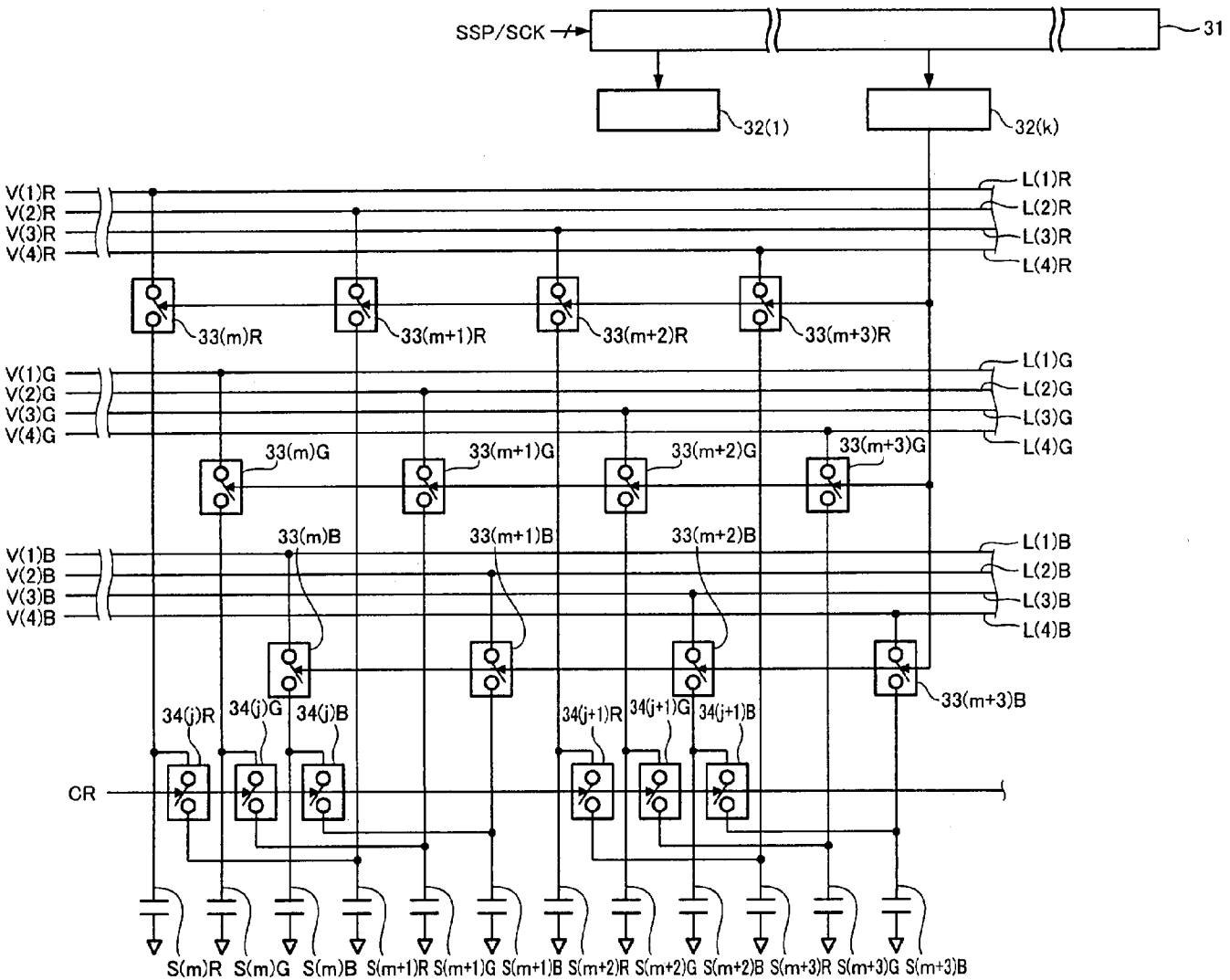
FIG. 7 is an explanatory diagram illustrating an arrangement of the source driver, in a case where the liquid crystal display device is a color liquid crystal display device.

The present display device, when it is a color display device, has source driver 2 with an arrangement as shown in FIG. 7. Note that, constituting elements having similar functions to those described with reference to FIG. 1 are given the same referential numerals.

In this case, the liquid crystal cell of the liquid crystal panel 1 is provided for each of the three channels R, G, and B in each pixel (three liquid crystal cells per pixel). Therefore, the number of liquid crystal cells is three times larger than that of the arrangement in FIG. 1.

As the number of channels is increased, the number of video signal lines also becomes three times larger. Specifically, video signal lines L(1)R to L(4)R, L(1)G to L(4)G, and L(1)B to L(4)B are provided for the source driver 2, instead of the L(1) to L(4) in FIG. 1.

Video signals V(1)R to V(4)R, V(1)G to V(4)G, and V(1)B to V(4)B are transmitted via the video signal lines L(1)R to L(4)R, L(1)G to L(4)G, and L(1)B to L(4)B.

Similarly, as the number of channels is increased, the number of source lines also becomes three times larger. Specifically, as shown in FIG. 7, the video signals V(1)R, V(1)G, and V(1)B are respectively transmitted to the three different cells in each pixel, via three different source lines S(m)R, S(m)G, and S(m)B, which are respectively provided for the three channels R, G, and B.

Further, the number of sampling switches, which are respectively provided for the source lines S(m)R, S(m)G, and S(m)B, also becomes three times larger. Specifically, instead of the sampling switch 33(*m*) in FIG. 1, sampling switches 33(*m*)R, 33(*m*)G, and 33(*m*)B are provided, which are respectively provided for the source lines S(m)R, S(m)G, and S(m)B.

Moreover, the number of bypass switches for bypassing the source lines also becomes three times larger. Specifically, instead of the bypass switch 34(*j*) for controlling a connection between the source lines S(m) and S(m+1) in FIG. 1, bypass switches 34(*j*)R, 34(*j*)G, and 34(*j*)B are provided, which are respectively provided for controlling connections between the source lines S(m)R and S(m+1)R, between the source lines S(m)G and S(m+1)G, and between the source lines S(m)B and S(m+1)B.

Thus, in the arrangement of FIG. 7, the shift register 31 and the voltage control circuits 32(1) to 32(*k*) are shared by the three channels R, G, and B. Meanwhile, the video signal lines, the source lines, the sampling switches, and the bypass switches are independent from channel to channel. In the description above, constituting elements that are independent from channel to channel are labeled with R, G, and B in their referential numerals, so as to indicate which channel they belong.

In the arrangement of FIG. 7, the operations in FIG. 1 (operations with respect to one channel) are performed for each of the channels R, G, and B, the operations of each channel being the same as the operations in FIG. 1. Accordingly, the operations with respect to FIG. 7 are not described here.

In the arrangement in FIG. 7, color display is performed using the channels of the three primary colors R, G, and B, respectively. However, the number of channels that can be used in the present display device is not limited to three. The number of channels may be two, or more than three.

Further, it is not always necessary that the channels are respectively provided for the three primary colors R, G, and B. Channels of other colors may be provided.

As in the arrangement of FIG. 4, the arrangement of FIG. 7 may be adapted so that the image lines which receive the split signals may be switched alternately.

As described above, a signal output device of the present invention (the present output device) for supplying image signals to source lines of a display device via an image line includes a bypass section which connects a predetermined number of the source lines with one another, so that the image signal to one of the predetermined number of the source lines is simultaneously supplied to all of the predetermined number of the source lines.

The present output device is used in a liquid display device, an EL (Electro Luminescence) display device, a plasma display device, and the like.

The display device displays an image by supplying image signals via source lines to pixels formed in a display screen.

The present output device supplies externally supplied image signals (video signals, still picture signals, and the like) via the image lines to the source lines of the display device.

In particular, the present output device includes the bypass section for connecting a predetermined number of the source lines with one another. The output device of the present invention is adapted to simultaneously supply the image signal via the bypass section to the source lines so connected, using the image signal to one of the connected source lines.

Thus, the present output device is capable of indirectly supplying, via the bypass section into the rest of the source lines, the image signal supplied to one of the source lines.

In this manner, the present output device is capable of simultaneously supplying a single image signal to a plurality of source lines. Because a plurality of pixels can simultaneously receive the image signal, the operating speed of image display can be increased. Moreover, a driving frequency can be lowered, provided that the operating speed is not changed. This enables power consumption to be reduced.

Furthermore, because the bypass section allows the signal to be transmitted between the source lines, the present output device is capable of transmitting the image signals on a smaller number of image lines than the number of the source lines that are simultaneously used to carry out display.

As a result, the display device can attain much lower power consumption than expected from the size (the number of source lines, and the like) of the display device.

Moreover, using the present output device in a display device, it is possible to realize a display device capable of supplying image signals to source lines with low power consumption.

It is preferable in the present output device that the source lines connected by the bypass section are adjacent to each other. In this way, it is possible to simplify a circuit structure of the present output device.

Moreover, the present output device may be provided with a plurality of image lines for transmitting image signals to the source lines. The output device may be adapted to connect the image lines respectively to the identical number of source lines in groups, so as to simultaneously supply the image signal to the source lines of each group. In this case, it is possible to simultaneously supply plural kinds of image signals to the pixels belonging to the plurality of source lines.

In this case, the image signals respectively supplied to the image lines may be split signals which are obtained by splitting an original image signal. In this way, the amount of information (a frequency characteristic) per image line can be reduced, and it is possible to easily increase the operating speed of the display device.

Moreover, in this case, the present output device includes a controlling section for performing multi phase process of the image signal. It is preferable that the control section performs multi phase so as to generate split signals in a number which is smaller than that of the image lines, and respectively supplies the split signals to the identical number of image lines.

It is preferable that the control section controls the bypass section so as to connect the source line connected to the image line that has received the split signal, with the source line connected to the image line that did not receive the split signal.

In this way, it is possible to reduce the number of the image lines to which the split signals are actually applied, with respect to the number of the source lines into which the split signals are simultaneously supplied. As a result, the display device can attain significantly lower power consumption.

It is preferable that the control section is adapted to generate the split signals in a number equal to the number of the image lines and respectively supplies the split signals to the image lines. Moreover, in this case, it is preferable that the control section prevents the bypass section from connecting between the source lines. With this control, it is possible to display images at high resolutions.

Moreover, it is preferable that the control section is adapted to switch, in accordance with external instructions and the like, image display modes between high resolution display and power saving display as described above.

In one aspect of the invention, the output device of the present invention as described above is an output device in which there are a plurality of image lines respectively connected to an identical number of the source lines in groups, so as to simultaneously supply the image signals to the source lines of each group, the signal output device further includes a control section for performing multi phase process of an original image signal so as to generate split signals and controlling the bypass section, in accordance with a low resolution mode or a high resolution mode, the low resolution mode being a display mode in which the split signals are generated in a number smaller than a number of the image lines, and the split signals are respectively supplied to an identical number of the image lines, and the bypass section is controlled so as to connect the source line connected to the image line that has received the split signal with the source line connected to the image line that did not receive the split signal, and the high resolution mode being a display mode in which the split signals are generated in a number equal to the number of the image lines, and the split signals are respectively supplied to an identical number of the image lines, and the bypass section is controlled so as to prevent the source lines from being connected with one another.

Moreover, in performing the power saving image display as above, it is preferable that the control section is adapted to switch, in every predetermined time period, the image lines which receive the split signals.

In this way, the source lines respectively receive the split signals directly from the image lines, or indirectly via the bypass section, depending on the time period.

Here, there is a possibility that the indirectly supplied split signals are influenced by, for example, resistance of the bypass section (voltage drop, etc.). In the arrangement above, the source lines that indirectly receive the split signals are not fixed but are switched. Therefore, it is possible to average the influence of the bypass section on the source lines in terms of time.

As a result, it is possible to prevent local distortion of images such as vertical stripes from occurring, thereby preventing deterioration of display quality.

The "predetermined time period" is a horizontal period or a vertical period, for example.

In switching the image lines that receive the split signals, whether or not the image lines receive the split signals is decided in every predetermined time period, when the number of split signals is half the number of image lines. When, on the other hand, the number of split signals is larger (or smaller) than half the number of image lines, a combination of the image lines that receive the split signals is changed.

It is possible to easily apply the output device of the present invention to a display device for carrying out color display (color display device). In this case, the display device includes a plurality of channels of source lines respectively provided for a plurality of display colors.

The "channel" referred to herein is a color displaying component of the present display device, provided for each display color. Therefore, each channel has picture elements of each display color (picture elements generating a single color) and source lines for transmitting the image signals to the picture elements.

In applying the present output device to such a color display device, the output device is provided with plural sets of image lines and bypass section, respectively for the channels of the display device.

As with the foregoing arrangement, a plurality of image lines may be provided for each channel, and the image lines may be connected to the identical number of source lines in groups, so as to simultaneously supply the image signals to the source lines of each group.

Furthermore, the output device may be adapted so that a control section for performing multi phase process of the image signals is provided, and that the image signals respectively supplied to the image lines are split signals obtained by performing multi phase process of the original image signal. In this case, as described above, it is preferable that the control section generates the split signals in a number which is smaller than the number of image lines, and respectively supplies the split signals to the identical number of image lines.

In applying the present output device to a color display device, it is preferable that the control section controls the bypass section with respect to each channel so as to connect the source line connected to the image line that has received the split signal with the source line connected to the image line that did not receive the split signal, thereby making it possible to carry out display with lower power consumption.

Furthermore, it is preferable that the present output device is adapted to be capable of displaying an image at high resolutions and switching, in accordance with input instructions, display modes between high resolution display and power saving display.

Furthermore, in the power saving display, the control section is preferably adapted so that the image lines that receive the split signals are switched in every predetermined time period. In this way, it is possible to average the influence of the bypass section on the split signals.

Further, it is preferable that the present output device includes a sampling switch, provided between each image line and each source line, for connecting therebetween when in an ON-state and disconnecting therebetween when in an OFF-state. In this case, it is preferable that the bypass section includes a voltage control circuit for turning ON or OFF the sampling switch, and a bypass switch for connecting the source line of the sampling switch being turned ON by the voltage control circuit with the source line of the sampling switch being turned OFF by the voltage control circuit. With this arrangement, it is possible to easily realize the bypass section.

It is also preferable that the control section of the present output device includes a multi phase circuit for performing multi phase process of an original image signal so as to generate split signals in a manner that is in accordance with the resolution mode, and a DAC section which receives the split signal from the multi phase circuit and supplies the split signal to the image line. With this arrangement, it is possible to easily realize the control section.

In a liquid crystal panel of polysilicon or CG silicon, the drivers are monolithically formed on the panel, owing to the fact that such a liquid crystal panel enjoys better TFT characteristics than that of an amorphous silicon panel. However, such a liquid crystal panel cannot obtain operating speed as high as that of an LSI, because transmission of signals via signal lines is delayed due to the physical length of the panel. As a countermeasure, a kind of parallel transmission known as multi phase is adopted in arranging a source driver circuit for horizontal driving. Specifically, video signals R, G, and B are each split into two to eight signals by such as serial-parallel conversion, and the resultant signals are transmitted via a plurality of video signal lines, so that the amount of information (a frequency characteristic) per signal line can be reduced.

Further, the CG silicon liquid crystal panel can have a simple resolution switching function by adding analog switches and the like to the source driver circuit for horizontal driving or to the gate driver circuit for vertical driving. Such a function is realized, in principle, by writing the same video signal into two adjacent pixels in the horizontal and vertical directions, that is, to a total of four pixels in the low resolution mode, while all the pixels respectively receive different signals in the high resolution mode. A source driver capable of switching the high resolution mode and the low resolution mode is disclosed, for example, in Japanese Publication for Unexamined Patent Application, No. 18193/1989 (Tokukaisho, 64-18193). An additional advantage of such an arrangement is that the driving frequency can be lowered to one fourth to reduce power consumption.

A conventional source driver circuit switches between the high resolution mode and the low resolution mode by differentiating or synchronizing the timing of supplying signals that control the sampling switches. It was therefore necessary to supply the same number of split video signals in the high resolution mode and in the low resolution mode.

In one aspect of the invention, the TFTs 12 are pixel transistors respectively provided to drive liquid crystal pixels (liquid crystal cells 11) that are arranged in a matrix; the gate driver 3 is a vertical scanning circuit (gate driver circuit) for performing a selecting operation by sequentially applying a gate driving pulse to a gate electrode of each pixel transistor (TFT 12); and a source driver 2 is a horizontal driving circuit (source driver circuit) for respectively writing the video signals into the liquid crystal pixels via the selected pixel transistors.

In one aspect of the present invention, each driving circuit of the present display device shown in FIG. 3 basically includes a shift register 21, a level shift circuit for shifting input voltage to a voltage that allows the TFT 12 to appropriately control the liquid crystal cell 11, and a buffer circuit for driving the liquid crystal cell 11. Further, in one aspect of the invention, the source driver 2 includes analog switches as sampling switches for sampling the video signals and transmitting the thus sampled video signals to sampling capacitors (source line capacitors).

In one aspect of the present invention, FIG. 1 shows the horizontal driving circuit (source driver circuit) 2 and the sampling capacitors (source line capacitors) in detail in order to explain the multi phase function in which a video signal is split into four signals and the simple function of switching resolutions in the horizontal direction. According to this arrangement, in the high resolution mode, a resolution control signal is supplied so that bypass switches 34(*j*) to 34(j+3), which are analog switches, are turned OFF, and each of the four video signals is supplied independently and simultaneously, and a voltage control circuit 32(*k*) performs sampling by simultaneously turning ON four analog switches 33(*m*) to 33(m+3) in accordance with a timing of a source clock. At the next rising timing of the source clock, the voltage control circuits 32(*k*) and 32(k+1), which are buffer/level shift circuits, operate so that a set of sampling switches 33(*m*) to 33(m+3) are turned OFF and the next set of sampling switches 33(m+4) to 33(m+7) turn ON.

On the other hand, in the low resolution mode, the resolution control signal is supplied to the bypass switches 34(*j*) to 34(j+3), which are analog switches, so that the bypass switches 34(*j*) to 34(j+3) are turned ON, and each of two video signals that are obtained by multi phase is supplied independently and simultaneously to video signal lines L(1) and L(3), and the voltage control circuit 32(*k*) samples the video signals by simultaneously turning ON the four analog switches of the sampling switches 33(*m*) to 33(m+3). The flows of the video signals in this case are indicated by the chain lines in FIG. 1. In accordance with a rising timing of the source clock, sampling capacitors of the source lines S(m) and S(m+2) receive the video signals that have been sampled without passing through the analog switches of the bypass switches 34(*j*) and 34(j+1), and sampling capacitors of the source lines S(m+1) and S(m+3) receive the video signals that have been sampled via the analog switches of the bypass switches 34(*j*) and 34(j+1).

Here, the video signal V(2) and the video signal V(4) are OFF (Hi-Z) so as to reduce power consumption, and therefore are ineffective even if the sampling switches 33(m+1) and 33(m+3) are turned ON. At the next rising timing of the source clock, the voltage control circuit 32(*k*) and 32(k+1) operate so that the set of sampling switches 33(*m*) to 33(m+3) are turned OFF and the next set of sampling switches 33(m+4) to 33(m+7) turn ON.

As a result, it is possible to write a video signal of one pixel into two pixels that are next to each other in the horizontal direction, thereby realizing simple low resolution display. It is also possible to write a video signal of one pixel into two pixels that are adjacent to each other in the vertical direction by applying this principle to the vertical direction, more specifically, by turning ON every two gate pulses simultaneously.

In one aspect of the present invention, the arrangement of FIG. 4 differs from that of FIG. 1 in that the voltage control circuits (buffer/level shift circuits) are provided to independently drive two adjacent sampling switches and a buffer selecting signal can be supplied to select the buffer/level shift circuits in a horizontal or vertical time period. Moreover, in the arrangement of FIG. 4, in the high resolution mode, the buffer selecting signal is supplied so that all the buffer/level shift circuits are selected, and the same operation of FIG. 1 is carried out. In the low resolution mode, the buffer signal is supplied so that one of the buffer/level shift circuits (j) and (j+1) is alternately selected in the horizontal or vertical time period. Here, the power consumption can be maintained at the level of FIG. 1 by alternately activating and insulating the video signals V(1) and V(3), and V(2) and V(4) in synchronization with the buffer selecting signal.

In the arrangement of FIG. 1, in the low resolution mode, every other pixel in the horizontal direction receives the video signal that was supplied via the bypass switch connected thereto. The ON resistance of the analog switch causes a slight difference in the amount of electrical charge between the pixel that receives the video signal supplied via the bypass switch and the pixel that receives the video signal that is not supplied via the bypass switch. This may cause vertical stripes to appear on a displayed screen, and damage display quality. On the other hand, in the arrangement in FIG. 4, the signal flow indicated by the chain lines and the signal flow indicated by the chain double dashed lines are alternately switched in the horizontal or vertical time period. Thus, the difference in charge amount, which occurs between the pixel that receives the video signal supplied via the bypass switch connected thereto and the pixel that receives the video signal that is not supplied via the bypass switch, can be averaged out in terms of time. As a result, the vertical stripes are prevented from occurring on the display screen, thereby preventing deterioration of display quality.

In FIG. 5, a buffer selecting signal (odd_en) for selecting the voltage control circuit 32(*j*) and a buffer selecting signal (even_en) for selecting the voltage control circuit 32(j+1) are respectively supplied to the voltage control circuits 32(*j*) and 32(j+1), which are mutually independent. The voltage control circuits 32(*j*) and 32(j+1) may be controlled so as to be effective ("H" level) in the high resolution mode, and may be controlled in the low resolution mode so as to be alternately selected in the horizontal or vertical time periods (in this example, odd_en="H"/"L", even_en="L"/"H").

In one aspect of the invention, FIG. 6 is a block diagram for explaining DAC sections 42(1) to 42(4), which have a function of multi phase to generate the video signals V(1) to V(4) that are supplied in the arrangement of FIG. 4. In this arrangement, in response to a resolution control signal, four video signals are generated in the high resolution mode by splitting the original video signal, and two video signals are generated in the low resolution mode by resolving the original video signal. When two video signals are generated by resolving the original video signal, the DAC sections 42(1) to 42(4), which output the video signals V(1) and V(3), and V(2) and V(4), receive the same data. The DAC sections 42(1) to 42(4) are respectively provided with power saving terminals, which receive the buffer selecting signals (odd_en) and (even_en), so that the DAC sections 42(1) to 42(4), which output the video signals V(1) and V(3), and V(2) and V(4), alternately operates in the horizontal or vertical time period.

The DAC sections of FIG. 6 may be used to realize the DAC sections in FIG. 1. However, unlike the example of FIG. 6, it is not necessary to switch the DAC sections 42(1) to 42(4), which output the video signals V(1) and V(3), and V(2) and V(4), in the horizontal or vertical time period.

The present invention is applicable to a liquid crystal display device on which a driver circuit is monolithically mounted, or a liquid crystal display device having an externally provided driver for a liquid crystal panel using amorphous silicon, or a display device other than a liquid display device. The arrangements shown in FIGS. 1 and 4 use the buffers that drive sampling switches. However, the buffers are not limited to current amplifying means. The buffers may be for adjusting width of an output waveform of the shift register, or the buffers may have both of these functions. Further, the present invention does not necessarily require buffers, and merely operate to select and supply the sampling signal SP.

In one aspect of the present invention, the present invention employs a color liquid crystal using three primary colors of R, G, and B, but FIG. 1 only describes the case of one of the R, G, and B channels for simplicity. The arrangement as shown in FIG. 1 is directly applicable to a monochrome liquid crystal. In case of a common color liquid crystal panel, the arrangement as shown in FIG. 7 is adopted, for example. In the arrangement of FIG. 7, video signals V(1)R to V(4)R, V(1)G to V(4)G, and V(1)B to V(4)B, which are independent from channel to channel, are respectively applied to video signal lines L(1)R to L(4)R, L(1)G to L(4)G, and L(1)B to L(4)B, which are independent from channel to channel. A shift register 31 and voltage control circuits 32(1) to 32(*k*) are commonly used. Sampling switches 33(1) to 33(*m*), bypass switches 34(1) to 34(*j*), and the like are independent from channel to channel. In FIG. 7, the same referential numerals of FIG. 1 are used for the like members, and members that are independent from channel to channel are labeled, after the referential numeral, with R, G, or B, which indicate the channel. The operations in FIG. 7 are the same as that in FIG. 1, except that the video signals, which are independent from channel to channel (R, G, and B), are applied simultaneously. The same is true with the other figures. Further, the applicable area of the present invention is not just limited to a color display device using the three primary colors of R, G, and B; it is possible to apply the present invention to other types of color display devices.

In one aspect of the invention, the present invention provides first to fourth driving circuits and a first display device, as described below. Specifically, a first driving circuit is a driving circuit that is provided with a shift register for supplying a sampling signal in accordance with a timing pulse and a clock signal, and sampling switches for sampling video signals in accordance with the sampling signal, and the first driving circuit includes: video signal multi phase means for respectively splitting the video signals into an 1 or 21 number of signals and respectively supplying, to input stages of the sampling switches, the resultant split signals, where 1 is a natural number; and bypass switches which are provided between adjacent signal lines 2i−1 and 2i that are respectively connected to output stages of the sampling switches, where i is a natural number.

A second driving circuit, which includes all of the elements of the first driving circuit, is a driving circuit in which the video multi phase means respectively splits the video signals into an 1 number of signals when the bypass switches are ON, and the video multi phase means respectively splits the video signals into a 21 number of signals when the bypass switches are OFF.

A third driving circuit, which includes all of the elements of the first or second driving circuit, includes sampling signal selecting means for selecting and supplying one or both of the sampling signals corresponding to the adjacent signal lines 2i−1 and 2i, which are connected to output stages of the shift register.

A fourth driving circuit (signal transmitting device) is a driving circuit for supplying image signals to source lines of a display device via image lines, and the fourth driving circuit includes a bypass section for connecting a predetermined number of source lines with one another, so as to simultaneously supply the image signal to the predetermined number of source lines, using the image signal to one of the predetermined number of source lines, the image lines being color image lines of n colors, where n is an integer of not less than 2, and the image line of n colors each has m image lines, where m is an integer of not less than 2, n×m image lines being connected to the same number of source lines in groups, so as to simultaneously output the image signal to the source lines of each group, and the fourth driving circuit further includes a control section for respectively performing multi phase process of the image signals of n colors, so as to generate less than m number of split signals, and outputting the resultant split signals into the same number of source lines, and the control section controlling the bypass section so as to connect, with respect to each color, the source line connected to the image line that has received the split signal, with the corresponding source line connected to the image line that did not receive the split signal.

A first display device includes: a plurality of pixels; a plurality of data signal lines and a plurality of scanning signal lines that are respectively provided to the pixels; a vertical scanning circuit for supplying scanning signals to the scanning signal lines; and a horizontal driving circuit for sampling and supplying, to the data signal lines, video signals to be respectively supplied to the pixels of the scanning signal lines that have received the scanning signals, wherein the horizontal driving circuit is one of the first to fourth driving circuits.

With the described arrangement of the display device including any of the first to fourth driving circuits and with the arrangement of the first display device, it is possible to suspend supplying unnecessary video signals in the low resolution mode (that is, fewer video signals are supplied than in the high resolution mode). Therefore, it is possible to reduce power consumption and improve display quality.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A signal output device for supplying image signals to source lines of a display device via an image line, comprising:

a bypass section which connects a predetermined number of the source lines with one another, so that the image signal to one of the predetermined number of the source lines is simultaneously supplied to all of the predetermined number of the source lines;

a plurality of image lines respectively connected to an identical number of the source lines in groups, so as to simultaneously supply the image signals to the source lines of each group;

a control section for performing multi phase process of an original image signal so as to generate split signals and controlling the bypass section, in accordance with a low resolution mode or a high resolution mode;

the low resolution mode being a display mode in which the split signals are generated in a number smaller than a number of the image lines, and the split signals are respectively supplied to an identical number of the image lines, and the bypass section is controlled so as to connect the source line connected to the image line that has received the split signal with the source line connected to the image line that did not receive the split signal; and the high resolution mode being a display mode in which the split signals are generated in a number equal to the number of the image lines, and the split signals are respectively supplied to an identical number of the image lines, and the bypass section is controlled so as to prevent the source lines from being connected with one another.

2. The signal output device as set forth in claim 1, further comprising:

a sampling switch, provided between each of the image lines and each of the source lines, which connects therebetween when in an ON-state and disconnects therebetween when in an OFF-state, the bypass section including:

a voltage control circuit for turning ON or OFF the sampling switch; and a bypass switch for connecting the source line of the sampling switch being turned ON by the voltage control circuit with the source line of the sampling switch being turned OFF by the voltage control circuit.

3. The signal output device as set forth in claim 1, wherein:

the control section is adapted to switch, in every predetermined time period, the image lines that receive the split signals.

4. The signal output device as set forth in claim 1, wherein:

the control section includes:

a multi phase circuit for performing the multi phase process of the image signal so as to generate the split signals in a number that is in accordance with the low resolution mode or the high resolution mode; and a DAC section which receives the split signal from the multi phase circuit and supplies the split signal to the image line.

5. The signal output device as set forth in claim 1, wherein:

the display device includes a plurality of channels for the source lines respectively corresponding to different display colors, and the image lines and the bypass section are provided in a set for each of the channels of the display device.

6. The signal output device as set forth in claim 5, wherein:

the display colors are red, blue, and green.

7. The signal output device as set forth in claim 1, wherein:

the display device is a matrix-type display device including a plurality of source lines and a plurality of gate lines, in which the source lines and the gate lines are arrayed orthogonal to one another in a lattice pattern, and a pixel is positioned at each intersection of the source lines and the gate lines.

8. The signal output device as set forth in claim 7, wherein:

the control section simultaneously turns ON the plurality of gate lines.

9. A display device, comprising:

a signal output device for supplying image signals to source lines of a display device via an image line, including:

a bypass section which connects a predetermined number of the source lines with one another, so that the image signal to one of the predetermined number of the source lines is simultaneously supplied to all of the predetermined number of the source lines;

a plurality of image lines respectively connected to an identical number of the source lines in groups, so as to simultaneously supply the image signals to the source lines of each group;

a control section for performing multi phase process of an original image signal so as to generate split signals and controlling the bypass section, in accordance with a low resolution mode or a high resolution mode;

the low resolution mode being a display mode in which the split signals are generated in a number smaller than a number of the image lines, and the split signals are respectively supplied to an identical number of the image lines, and the bypass section is controlled so as to connect the source line connected to the image line that has received the split signal with the source line connected to the image line that did not receive the split signal; and the high resolution mode being a display mode in which the split signals are generated in a number equal to the number of the image lines, and the split signals are respectively supplied to an identical number of the image lines, and the bypass section is controlled so as to prevent the source lines from being connected with one another.

10. The display device as set forth in claim 9, wherein:

the signal output device, with a display panel for displaying an image, are monolithically mounted on a substrate of CG silicon.

11. A signal output method for supplying image signals to source lines of a display device via image lines, comprising the step of:

connecting a predetermined number of the source lines with one another, so that the image signal to one of the predetermined number of the source lines is simultaneously supplied to all of the predetermined number of the source lines;

connecting a plurality of image lines respectively to an identical number of the source lines in groups, so as to simultaneously supply the image signals to the source lines of each group;

performing a multi phase process of an original image signal so as to generate split signals and controlling the bypass section, in accordance with a low resolution mode or a high resolution mode;

the low resolution mode being a display mode in which the split signals are generated in a number smaller than a number of the image lines, and the split signals are respectively supplied to an identical number of the image lines, and the bypass section is controlled so as to connect the source line connected to the image line that has received the split signal with the source line connected to the image line tat did not receive the split signal; and the high resolution mode being a display mode in which the split signals are generated in a number equal to the number of the image lines, and the split signals are respectively supplied to an identical number of the image lines, and the bypass section is controlled so as to prevent the source lines from being connected with one another.

12. A display device, comprising:

a signal output device for supplying image signals to source lines of a display device via an image line, including:

a bypass section operable during a display operation for selectively connecting a predetermined number of the source lines with one another, so that the image signal to one of the predetermined number of the source lines is selectively simultaneously supplied to all of the predetermined number of the source lines;

a plurality of image lines respectively connected to an identical number of the source lines in groups, so as to simultaneously supply the image signals to the source lines of each group; and wherein the signal output device further comprises:

a control section for performing multi phase process of an original image signal so as to generate split signals and controlling the bypass section, in accordance with a low resolution mode or a high resolution mode;

the low resolution mode being a display mode in which the split signals are generated in a number smaller than a number of the image lines, and the split signals are respectively supplied to an identical number of the image lines, and the bypass section is controlled so as to connect the source line connected to the image line that has received the split signal with the source line connected to the image line that did not receive the split signal; and, the high resolution mode being a display mode in which the split signals are generated in a number equal to the number of the image lines, and the split signals are respectively supplied to an identical number of the image lines, and the bypass section is controlled so as to prevent the source lines from being connected with one another.

13. The display device as set forth in claim 12, wherein the bypass section is operable according to input user instructions during the display operation for selectively connecting the predetermined number of the source lines with one another.

14. The display device as set forth in claim 12, wherein the bypass section is operable according to a display resolution mode signal during the display operation for selectively connecting the predetermined number of the source lines with one another.

15. The display device as set forth in claim 12, wherein:

there are a plurality of image lines respectively connected to an identical number of the source lines in groups, so as to simultaneously supply the image signals to the source lines of each group, and the signal output device further comprises:

a control section for performing multi phase process of an original image signal so as to generate split signals in a number smaller than a number of the image lines, and respectively supplying the split signals to an identical number of the image lines, and the control section controlling the bypass section so as to connect the source line connected to the image line that has received the split signal with the source line connected to the image line that did not receive the split signal.

16. The display device as set forth in claim 15, further comprising:

a sampling switch, provided between each of the image lines and each of the source lines, which connects therebetween when in an ON-state and disconnects therebetween when in an OFF-state, the bypass section including:

a voltage control circuit for turning ON or OFF the sampling switch; and a bypass switch for connecting the source line of the sampling switch being turned ON by the voltage control circuit with the source line of the sampling switch being turned OFF by the voltage control circuit.

17. The display device as set forth in claim 15, wherein:

the control section is adapted to switch, in every predetermined time periods the image lines that receive the split signals.

* * * * *